US008905902B2

(12) United States Patent
Burcham

(10) Patent No.: US 8,905,902 B2
(45) Date of Patent: Dec. 9, 2014

(54) EXERCISE KIT

(71) Applicant: David Earl Burcham, Louisville, KY (US)

(72) Inventor: David Earl Burcham, Louisville, KY (US)

( * ) Notice: Subject to any disclaimer, the term of this patent is extended or adjusted under 35 U.S.C. 154(b) by 157 days.

(21) Appl. No.: 13/670,524

(22) Filed: Nov. 7, 2012

(65) Prior Publication Data

US 2014/0128230 A1 May 8, 2014

(51) Int. Cl.
*A63B 21/02* (2006.01)
*A63B 21/00* (2006.01)
*A63B 26/00* (2006.01)

(52) U.S. Cl.
CPC ..... *A63B 21/00007* (2013.01)
USPC ..... 482/123; 482/92; 482/142

(58) Field of Classification Search
USPC ..... 482/21–126, 129–130, 141
See application file for complete search history.

(56) References Cited

U.S. PATENT DOCUMENTS

| | | | | | |
|---|---|---|---|---|---|
| 118,740 | A | * | 9/1871 | Oconnor | 482/123 |
| 2,461,682 | A | * | 2/1949 | De Ferrari | 482/130 |
| 3,815,904 | A | * | 6/1974 | Weiss et al. | 482/123 |
| 4,198,044 | A | * | 4/1980 | Holappa | 482/130 |
| 4,575,077 | A | | 3/1986 | Osborne et al. | |
| 5,060,939 | A | | 10/1991 | Oswald et al. | |
| 5,112,287 | A | * | 5/1992 | Brewer | 482/130 |
| 5,141,482 | A | * | 8/1992 | Hern | 482/130 |
| 5,197,934 | A | * | 3/1993 | Wirtz | 482/123 |
| 5,269,737 | A | * | 12/1993 | Sobotka | 482/123 |
| 5,395,296 | A | * | 3/1995 | Webster et al. | 482/130 |
| 5,462,510 | A | | 10/1995 | Ish, III | |
| 5,891,004 | A | * | 4/1999 | Berry | 482/129 |
| 6,030,324 | A | | 2/2000 | McBride | |
| 6,059,698 | A | * | 5/2000 | Mazor | 482/79 |
| 6,099,438 | A | * | 8/2000 | Dawson | 482/47 |
| 6,220,994 | B1 | * | 4/2001 | Rich | 482/123 |
| 6,287,243 | B1 | | 9/2001 | Isom | |
| 6,402,668 | B1 | * | 6/2002 | Harker | 482/121 |
| 6,645,130 | B2 | | 11/2003 | Webber | |
| 7,041,041 | B1 | * | 5/2006 | Evans | 482/126 |
| 7,335,145 | B2 | | 2/2008 | Webber | |
| 7,431,681 | B1 | * | 10/2008 | St. Cyr | 482/121 |
| 7,637,855 | B2 | * | 12/2009 | Bizzell et al. | 482/142 |
| 7,946,969 | B1 | * | 5/2011 | Friess et al. | 482/123 |
| 8,360,940 | B2 | * | 1/2013 | Kole et al. | 482/121 |
| 8,715,144 | B1 | * | 5/2014 | Friess et al. | 482/123 |
| 2003/0195098 | A1 | * | 10/2003 | Hsu | 482/148 |
| 2004/0087420 | A1 | * | 5/2004 | Montesquieux | 482/129 |
| 2005/0107226 | A1 | * | 5/2005 | Monda | 482/121 |
| 2006/0128540 | A1 | * | 6/2006 | Engle | 482/123 |
| 2007/0270292 | A1 | * | 11/2007 | Laney | 482/121 |
| 2010/0125030 | A1 | * | 5/2010 | Shifferaw | 482/94 |
| 2011/0251033 | A1 | * | 10/2011 | Blancher | 482/123 |
| 2013/0244840 | A1 | * | 9/2013 | Thompson | 482/93 |

* cited by examiner

*Primary Examiner* — Loan H Thanh
*Assistant Examiner* — Garrett Atkinson
(74) *Attorney, Agent, or Firm* — RG Patent Consulting LLC

(57) ABSTRACT

A kit for performing exercises. The kit includes a back board, a standing board and a bench press bar. The kit also includes a plurality of bungee cords that are of different strengths and which can be attached to the various elements of the kit to establish a precise resistance to accommodate a particular user for a particular exercise.

1 Claim, 9 Drawing Sheets

270
270
230
240
250
260
10
230
178
190
182
170
172
196
194
174
180
200
204
184
192
210
220
176

EXERCISE KIT

TECHNICAL FIELD OF THE INVENTION

This invention relates to exercise equipment and, in particular, to versatile exercise benches that are adjustable to various configurations to accommodate various exercises.

BACKGROUND OF THE INVENTION

Weight lifting exercise benches have been known in the art for a number of years. More recently, as physical fitness has gained greater public interest and awareness, a number of developments have occurred in the design and use of exercise benches.

The original exercise bench, which is still in use, comprises a flat raised horizontal platform supported by a frame upon which a user lies while performing various arm exercises, such as bench presses and pullovers (which develop the triceps and chest muscle groups.)

The use of this original bench has limitations, in that an assistant was generally required to hand the weights to and take the weights from the bench user. Moreover, a bench user, who performed exercises thereon without assistance, could be injured if he became exhausted and was unable to escape from under the weights.

To improve the above-described original bench design, vertical support members at one end of the bench were extended above the level of the platform and "J"-shaped hook members were added to the upper portions of the extended vertical support members, thereby allowing the barbell weights to be supported above the users head and shoulders. This improved exercise bench was therefore, more convenient and safer in that a user could install a barbell on the "J"-shaped hook without assistance, and could place the barbell thereon after completion of his exercise so that he could escape from under said barbell.

Thereafter, exercise benches were provided with a platform having means for slanting the head end thereof upward relative to the horizontal portion of the end of the platform supporting a user's trunk. Using the aforementioned configuration, a weight lifter, by bench pressing with his upper torso inclined upward from a horizontal position, is required to use certain muscle groups of the upper chest and shoulders, which muscle groups would not otherwise be exercised to the same extent.

Another improvement to exercise benches is the addition of a leg exercising means. These leg exercising means are of two types, although many contemporary benches comprise both types in a single embodiment. The first type of such leg exercise means enables the development of the front thigh muscles, and more specifically, the quadriceps femoris (rectus femoris, vastus intermedius, vastus medials) vastus internua, sartorius, and patella tendon. In this exercise, the user sits or lies on his back on the platform with his legs hanging downward over one end thereof. The user's legs are tucked behind a padded member which is connected to the end of a vertical bar extending downward, the vertical bar being pivotally connected at its other end to the frame of the bench near the user's knees, such that the said vertical bar may be rotated about its pivot axis to a position approximately planar with the platform. Thus, when the user straightens his leg by flexing the quadriceps, he pivots his lower leg forward approximately 90° so that it is planar with the platform. A resistance may be added to the pivoting bar such as weights, an elastic or spring means, hydraulic pressure resistance or a pulley system.

This leg exercise means is deficient in at least two respects. Firstly, the lower leg which has a pivoting range at the knee of 135° or more, is not provided with its full range of motion, and therefore, the full potential benefit of the exercise is not achieved. Generally, the greater the range of angular movement of a joint during an exercise, the more benefit is derived from that exercise. Secondly, there is a tendency for some bench users performing this leg exercise to lift the whole leg from the hip rather than just using the quadriceps (e.g. to cheat on the exercise). Therefore, proper isolation of the select muscle groups for which this exercise is designed is not achieved using the prior art device. The present invention solves the foregoing problems.

The second type of leg exercise means associated with the use of an exercise bench enables the development of the back thigh and buttocks muscles, and more specifically, the hamstrings (biceps femoris, semimembranosus) and gluteus maximus. In this exercise, a user lies on the bench platform on his stomach with his leg tucked under a padded portion of a horizontal bar extending approximately planar with the platform, which bar is pivotally connected to the frame in a manner similar to the aforementioned leg extension exercise bar. Weights or other resistance means are applied to the bar as previously described. The user curls his lower legs upward and towards his buttocks.

This exercise bench is deficient in a number of respects in connection with the performance of the back leg and buttocks exercise described above. In performing this exercise on the prior art flat bench, as the horizontal bar is raised by the user's legs, the hips act as a fulcrum between the leg exercise bar pushing downward and backward on the leg, on the one hand, and the weight of the upper torso of the user, on the other hand. There is a tendency in this exercise to flex the back muscles to resist this fulcrum effect and to utilize the upper torso to rock or jerk the leg exercise bar upward. This rocking or jerking, in turn, can cause back muscle strain or more serious back injury. The present invention minimizes the risks of such strain or injury. The present invention also allows the user to isolate the muscle groups for which this exercise is intended, by making it difficult to utilize other muscles to cheat on the exercise.

To facilitate the performance of the leg extension exercise, there is a prior art exercise bench having a platform including head and foot sections divided by a hinge which is fixed in position at the horizontal plane of the platform, and a means for raising the end of the foot section of the platform. Using this bench, the above-noted deficiencies with regard to the leg extension exercise are avoided. However, this prior art bench cannot be used or adapted to aid in the performance of the leg curl exercise for which the hinge should be raised above the level of the platform.

Another bench is also available having a platform fixed in the shape of an upside down "V" to overcome the above-described deficiencies of a flat bench for performing the second type of leg exercise. However, this bench is only most conveniently usable for performing the leg curl. Moreover, none of the prior art exercise benches disclose the selective vertical translation of the pivoting means in the middle section of the platform.

Prior art exercise benches are also known in the art which combine the two types of leg exercise means into a single apparatus. In such benches, the horizontal bar is attached perpendicularly to a downward extending vertical bar to form a combination leg exercise means, which attaches to the frame of the bench near the intersection between said bars. The foregoing deficiencies of the two leg exercise means applies equally to this combination system.

There is a trend in the improvement of these exercise benches toward providing improved safety, increasing the number of different muscle groups which can be developed by its use, and enabling the selective isolation of various muscle groups for exercise. Thus, a weight lifter can specifically strengthen desired muscle groups. Similarly, body builders who, unlike weight lifters, exercise to develop the size and appearance of specific muscle groups, rather than strength, can also selectively isolate desired muscle groups.

Accordingly, the industry has continued to develop many forms of benches.

Benches of various sizes and configurations are now used by exercisers to assist in the performance of a variety of exercises. Different bench configurations permit an exerciser to perform different exercises thereon to exercise and isolate different sets of muscles.

For example, an inclined bench includes a seat and a backrest extending up from the seat inclined with respect to the floor so that the upper portion of the backrest is above the lower portion of the backrest. An exerciser may sit on the seat and recline in an at least partially upright position against the inclined backrest and can perform a variety of upper body exercises on the bench with weight or resistance training devices, such as dumbbells. The exercises which can be performed include chest press, lateral butterfly, and arm curl, each of which isolates and exercises a particular set of upper body muscles.

A flat bench provides a generally horizontal backrest upon which an exerciser may lie in a supine position. Again, the exerciser can perform chest presses and lateral butterflies, isolating a different set of upper body muscles then when the same exercises are performed on an incline bench. In addition, the exerciser can sit upright on the flat bench and perform a shoulder press exercise.

A slant board presents a declined backrest, i.e., a head portion of the backrest is disposed below a seat portion of the backrest. A slant board typically also includes foot holding structures. An exerciser can lie upon the slant board with his upper body disposed below his lower body and can perform chest presses, lateral butterflies, and a variety of abdominal exercises such as sit-ups and crunches. The exerciser can hold his feet stationary by engaging his feet with the foot holding structures. The user can also reverse positions on the slant board, so that the upper body is above the lower body, and perform inclined leg lift abdominal exercises.

Depending on the desired use, an individual may need a fixed horizontal bench or a bench capable of providing various back rest angles relative to the surface on which the bench is supported. Manufacturers have provided fixed horizontal benches, benches with an adjustable back rest, and benches with an adjustable back rest and separately adjustable bottom rest. Benches of these types have significant drawbacks. For example, a bench which remains horizontal relative to the bench supporting surface, such as a floor, limits the variety of exercises the user may perform. A bench having only an adjustable back rest does not provide a sound foundation for the user because the user tends to slide forward on the horizontal bottom rest while performing exercises. A bench with a separately adjustable back rest and bottom rest theoretically can provide appropriate back rest and corresponding bottom rest angles. However, this latter type of bench is inconvenient due to the multiple adjustment mechanisms needed to try to optimize the angle of the bottom rest relative to the back rest. Moreover, this type of bench requires the user to have knowledge of the appropriate settings to achieve proper angular adjustments. In addition, this type of prior art bench tends to have a common pivot axis on the frame for both the back rest and bottom rest. A common pivot for both the back rest and bottom rest is disadvantageous because the bottom rest should ideally be moved lower toward the bench supporting surface when the back rest is in more upright positions. The common pivot typically requires the leading edge of the bottom rest to be moved upward to tilt the bottom rest. This tends to force apart the legs of the user and tends to increase lower back hyperextension.

For example, U.S. Pat. No. 5,462,510 discloses an exercise bench having a relatively complicated structure wherein adjustment of the angle of the back rest simultaneously provides limited adjustment of the angle of the bottom rest relative to the bench supporting surface. This patent discloses multiple back rest positions, yet the bottom rest only attains a horizontal position (relative to the floor) and two other angled positions. Thus, the appropriate bottom rest position is not attained for each respective back rest angle. Moreover, when the bottom rest is tilted toward the back rest, a significant portion of the bottom rest rises, moving further away from the bench supporting surface. Hence the user experiences the same disadvantages of the earlier prior art, such as forcing apart of the legs and tendency to increase lower back hyperextension.

Convertible exercise benches of various types are known in the prior art. Among these are benches which are convertible between a chair-like configuration for supporting a user in a seated position with a back support, and a bench-like configuration for supporting the user in a reclining position. These types of devices typically employ fairly complicated linkages and are difficult to reconfigure, often requiring the removal and repositioning of multiple pins which lock the various bench components in desired positions. These complex constructions and the complexity of use associated with them make these prior art bench construction somewhat difficult and time consuming to use. A need therefore exists for a multi-position exercise bench which is much simpler to use than prior art structures.

Multiple position exercise benches are commonly known in the field as FID benches (flat-incline-decline), referring to the different possible bench positions. The FID bench has been a staple in the fitness industry for many years. Some FID benches may be folded for storage purposes while others do not have the ability to fold. U.S. Pat. No. 6,645,130 of Webber describes an adjustable exercise bench which can be folded into an upright orientation for storage. Some foldable benches are still fairly bulky and difficult to carry when folded, and have parts which protrude in the folded position, requiring more storage space.

To take advantage of the variety of exercises which may be performed on the various bench configurations described above, one would conventionally need multiple benches of different configurations. The need for multiple benches can present space problems, especially for the home user, and also leads to the added expense of purchasing multiple different benches.

Therefore, there is a need for an exercise kit that can overcome the disadvantages associated with benches.

There is a further need for an exercise system that will provide the versatility required for a complete exercise routine, yet can be efficiently stored, as well as efficiently set up and configured for use.

SUMMARY OF THE INVENTION

The above-discussed disadvantages of the prior art are overcome by an exercise system which can be efficiently configured in multiple positions so multiple exercises can be performed thereon, yet is amenable to efficient storage. The kit embodying the present invention overcomes the disadvantages associated with benches by eliminating the need for a bench while providing a means for performing all of the exercises generally associated with a bench and which in the past have required the use of a bench.

The system allows a multiplicity of exercises, including, but not limited to: both horizontal and vertical bench-type press exercises; sitting or standing curls; standing straight arm deltoid exercises; sitting and butterfly exercises; standing or sitting back-pull over; reclining presses. The system keeps all upper and lower muscles toned and strong and will benefit cardiovascular systems as well. The system allows a user to burn calories while building his or her cardiovascular system, while remaining portable and easily stored and while eliminating the need for a bench.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Referring to the figures, it can be understood that the present invention is embodied in a gym kit which permits a plurality of exercises to be performed, with each exercise being designed to create the precise amount of resistance required for the particular user and the particular exercise.

Figure 2A:
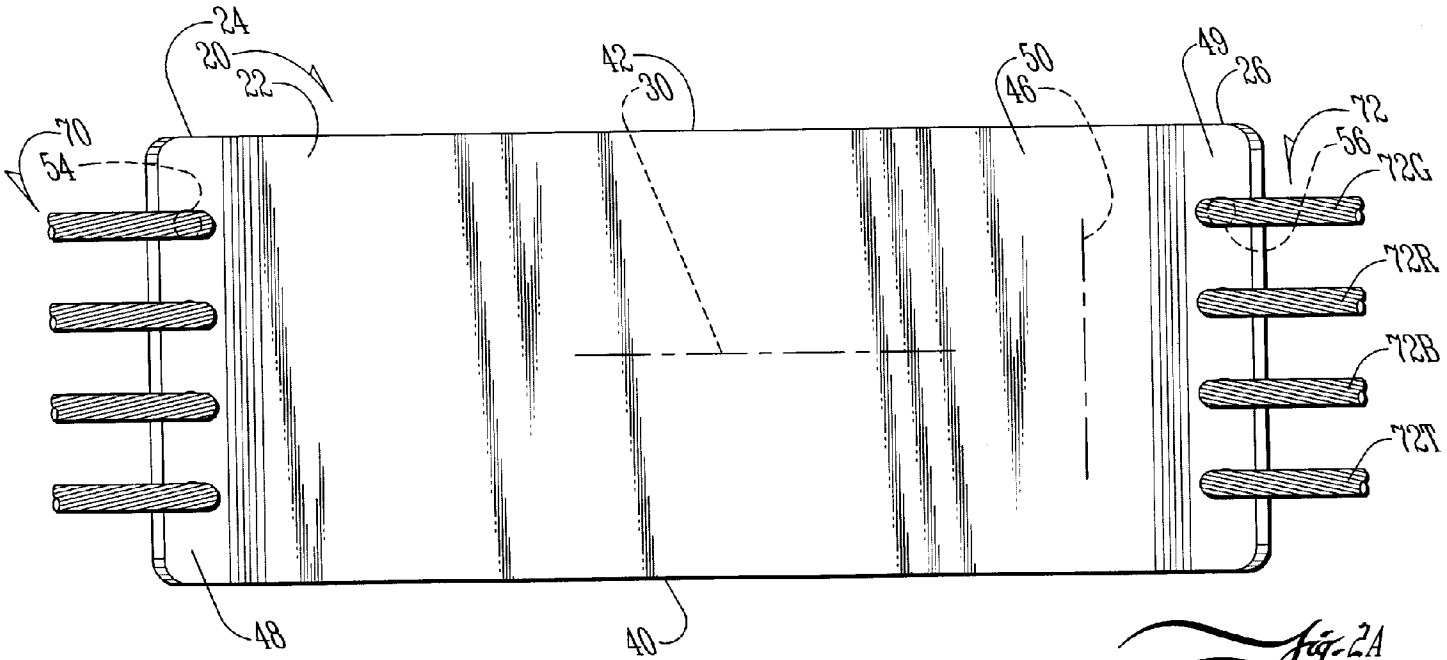
FIG. 2A is a plan view of the back board included in the kit embodying the present invention.
Figure 2B:
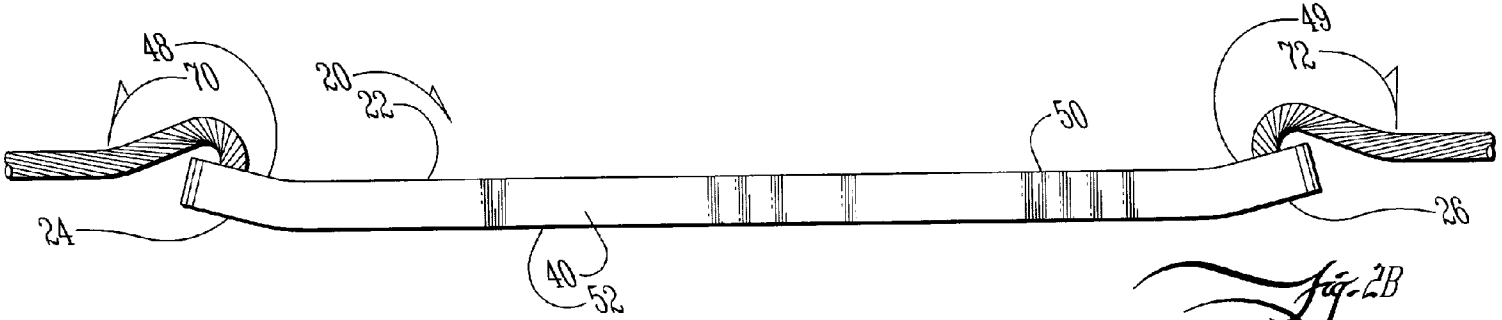
FIG. 2B is a side elevational view of the back board.
Figure 2C:
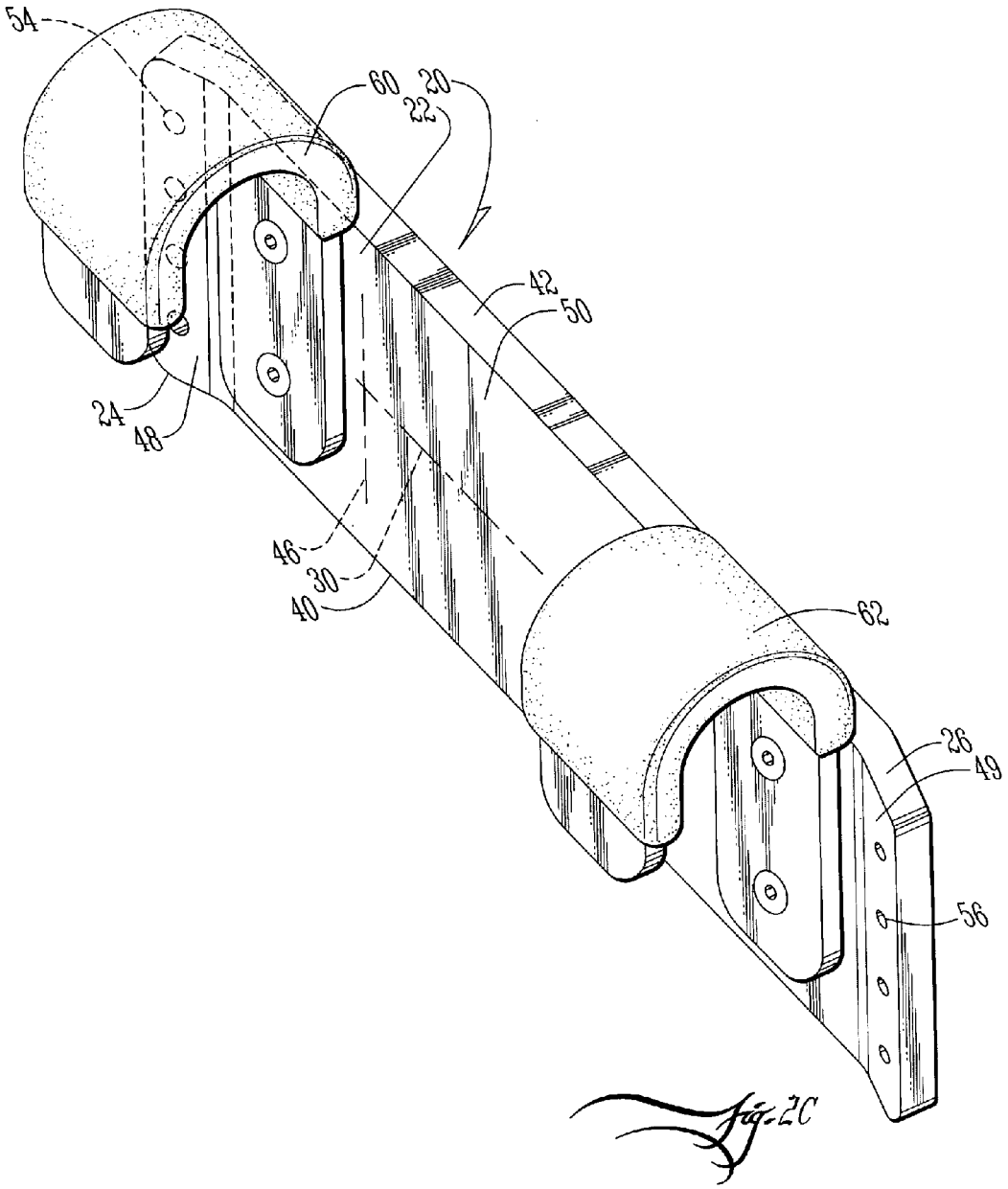
FIG. 2C is a perspective view of the back board showing the shoulder supports mounted thereon.

The kit comprises a back board 20. Back board 20 is shown in FIGS. 2A, 2B and 2C and includes a main body 22 with a first end 24, a second end 26 with the first and second ends being spaced apart from each other along a longitudinal axis 30 of the main body. The back board further includes a first side 40, a second side 42 with the first and second sides being spaced apart from each other along a transverse axis 46 of the main body. The main body can be curved along the longitudinal axis adjacent to the ends thereof if desired as indicated in FIG. 2B by curved portions 48 and 49 adjacent to ends 24 and 26 respectively.

Figure 6:
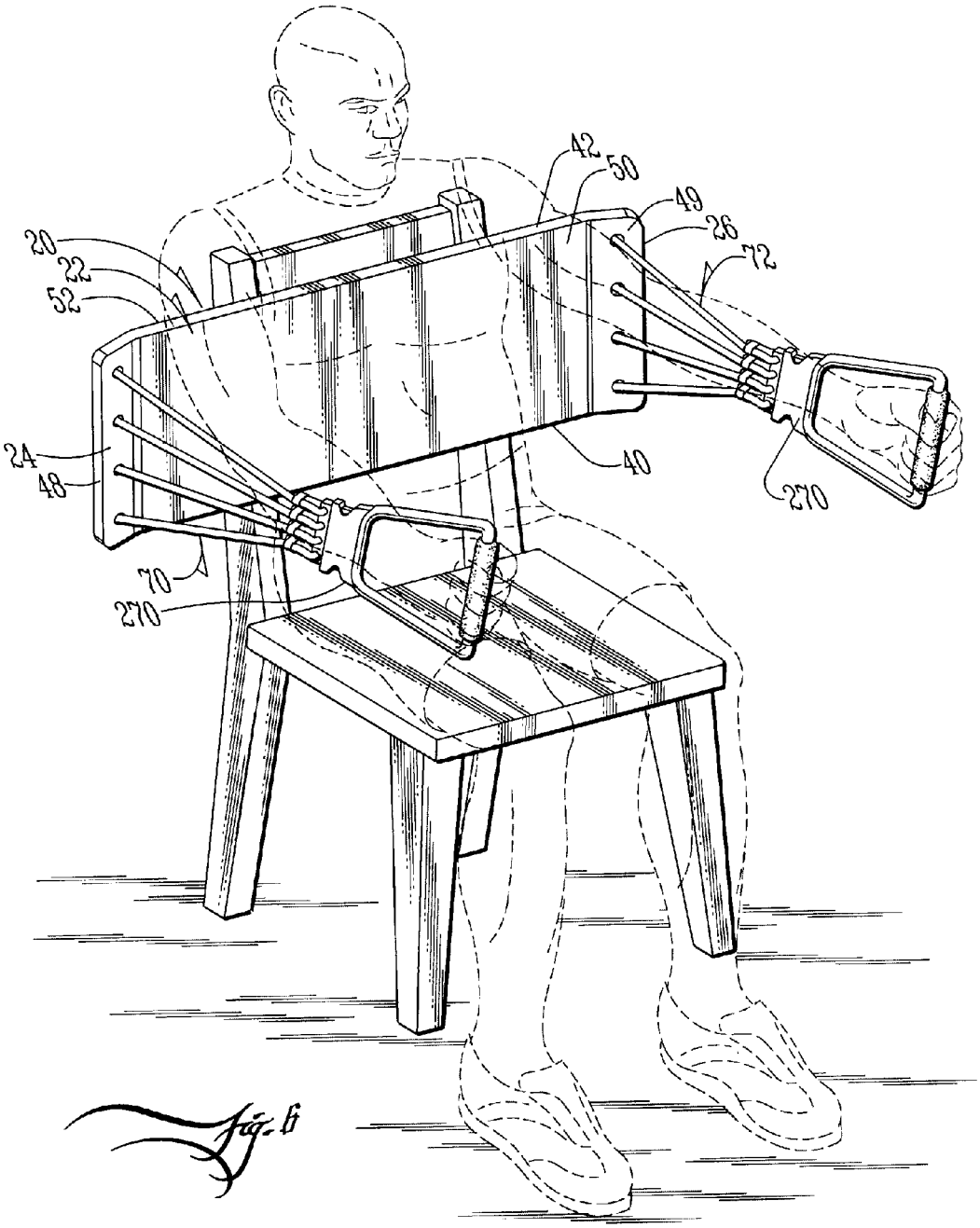
FIG. 6 illustrates a butterfly exercise using the back board.

The main body further includes a first surface 50 and a second surface 52. A first plurality of holes, such as hole 54 and 56 respectively, are defined through the main body from the first surface to the second surface and are located adjacent to each of the first and second ends of the main body. A first shoulder support 60 is removably attached to the first surface and a second shoulder support 62 is removably attached to the first surface adjacent to the second end. The shoulder supports are J-shaped and are each fixed the first surface of the back board. Shoulder supports 60 and 62 are removed so the body can be used as shown in FIG. 6. While not specifically shown in FIG. 2C, shoulder supports 60 and 62 fit over and on top of a user's shoulders during use of the item shown in FIG. 2C with the board located adjacent to the user's back; whereas, FIG. 6 shows the board located adjacent to the user's chest.

Each of a first plurality of bungee cords, such as cords and 72 are 70, is attached to the main body via one of the first plurality of holes 54 and 56 respectively. Each bungee cord of the first plurality of bungee cords has a unique strength and color, with the color of a bungee cord corresponding to the strength of the bungee cord associated therewith, with a stronger bungee cord having more tension than a weaker bungee cord. For example, bungee cord 72G is green, bungee cord 72R is red, bungee cord 72B is blue and bungee cord 72T is tan. The cords can be attached to the back board in any combination to effect a particular tension or strength against which the user works. For example, all the cords could be green cords for one tension and all the cords could be blue for another. FIG. 2A illustrates one particular combination of cords, and those skilled in the art will understand that other combinations are possible based on the teaching of this disclosure.

Figure 4A:
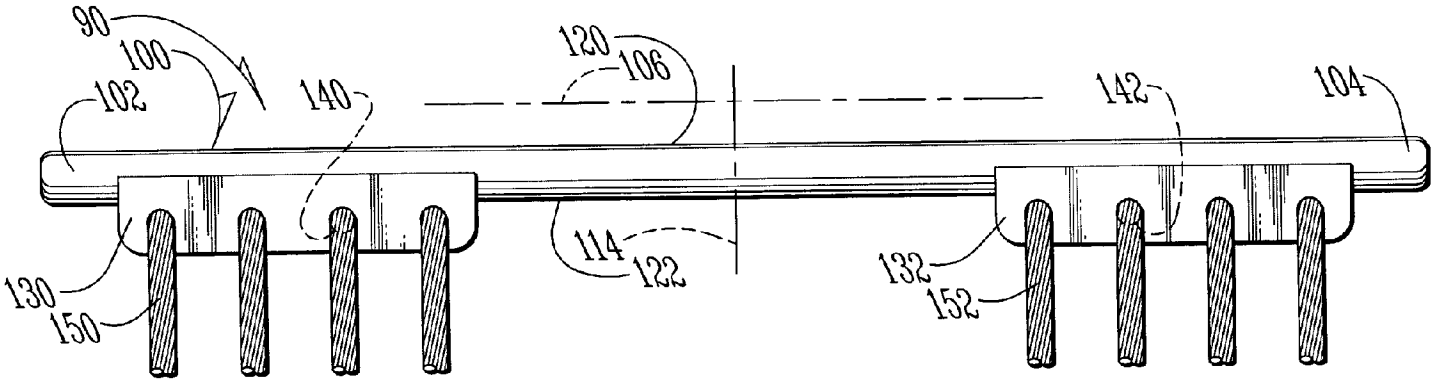
FIG. 4A is a side elevational view of a bench press bar included in the kit embodying the present invention.
Figure 4B:
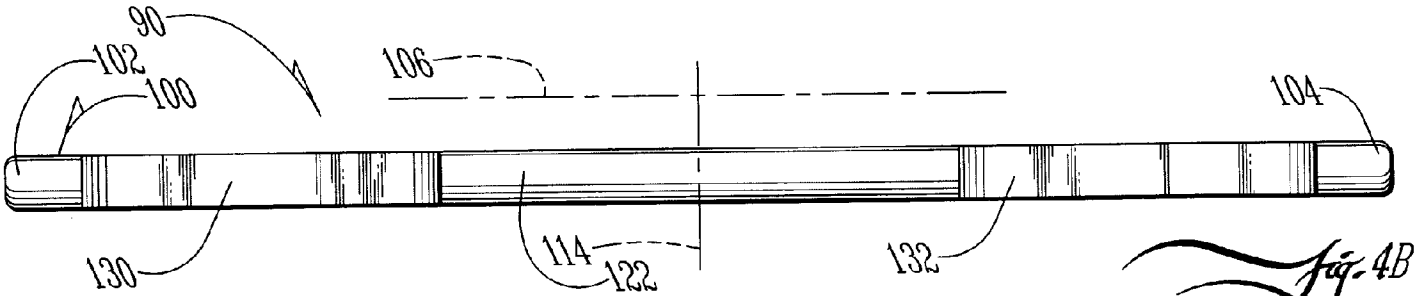
FIG. 4B is a plan view of the bench press bar.

The kit further includes a bench press bar 90 which is shown in FIGS. 4A and 4B and which has a main body 100 with a first end 102, a second end 104 which are spaced apart from each other along a longitudinal axis 106 of the bench press bar. Bar 90 has a first side 110 and a second side 112 which are spaced apart from each other along a transverse axis 114 of the bench press bar. Bar 90 further includes a first surface 120 and a second surface 122. A first bracket 130 is mounted on the second surface of the bench press bar adjacent to the first side of the bench press bar, and a second bracket 132 is mounted on the second surface of the bench press bar adjacent to the first side of the bench press bar. The second bracket is spaced apart from the first bracket along the longitudinal axis of the bench press bar.

The bench press bar further includes a second plurality of holes, such as hole 140 defined through the first bracket, and a third plurality of holes, such as hole 142 defined through the second bracket.

A second plurality of bungee cords, such as bungee cord 150, are attached to first bracket via the second plurality of holes, and a third plurality of bungee cords, such as bungee cord 152, are attached to the second bracket via the third plurality of holes. As with the first plurality of bungee cords, each bungee cord of the second and third plurality of bungee cords has a unique strength and color, with the color of a bungee cord corresponding to the strength of the bungee cord associated therewith, with a stronger bungee cord having more tension than a weaker bungee cord.

Figure 1:
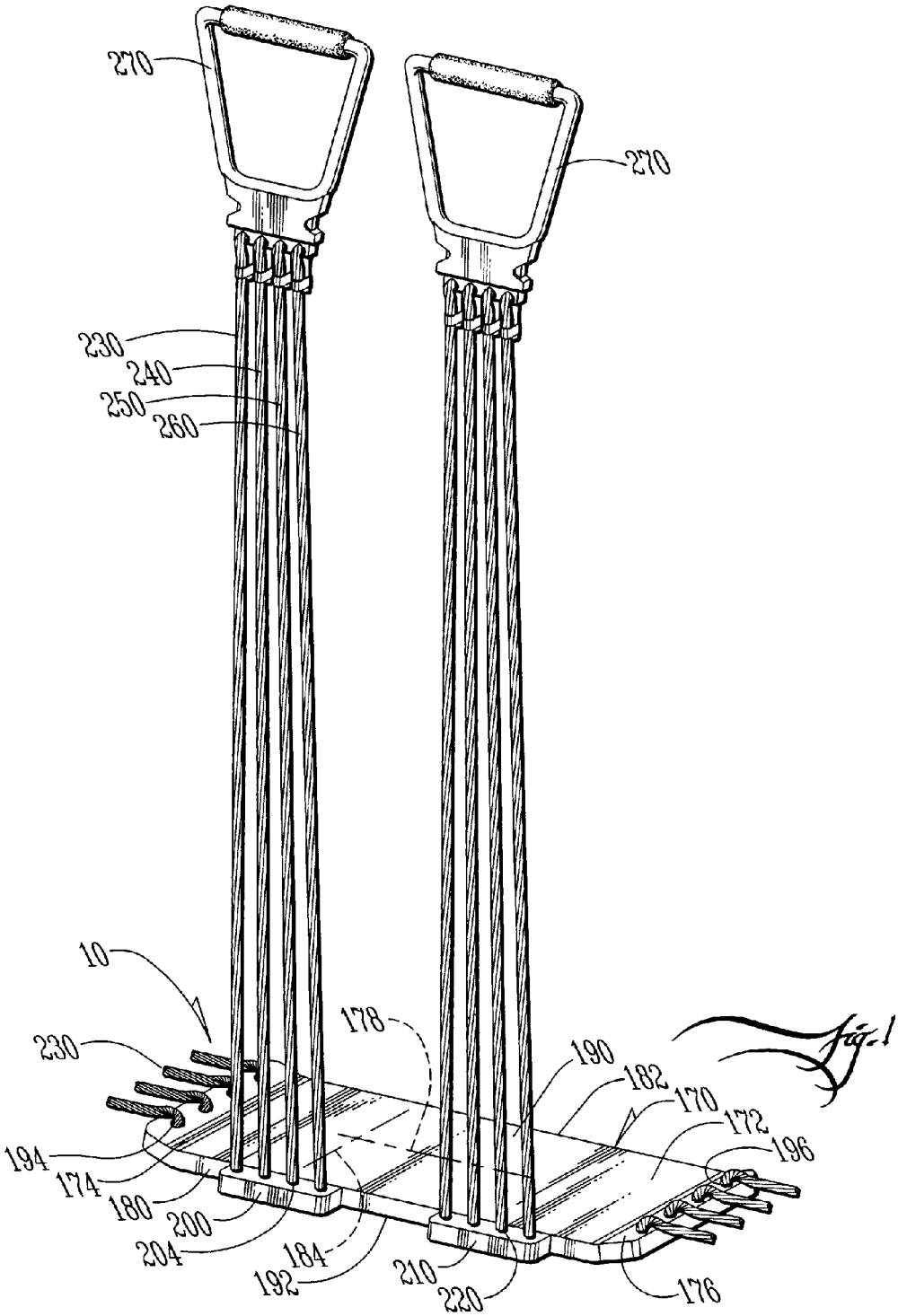
FIG. 1 is a perspective view of a standing board having handles attached thereto by bungee cords in one configuration of the kit embodying the present invention.
Figure 3:
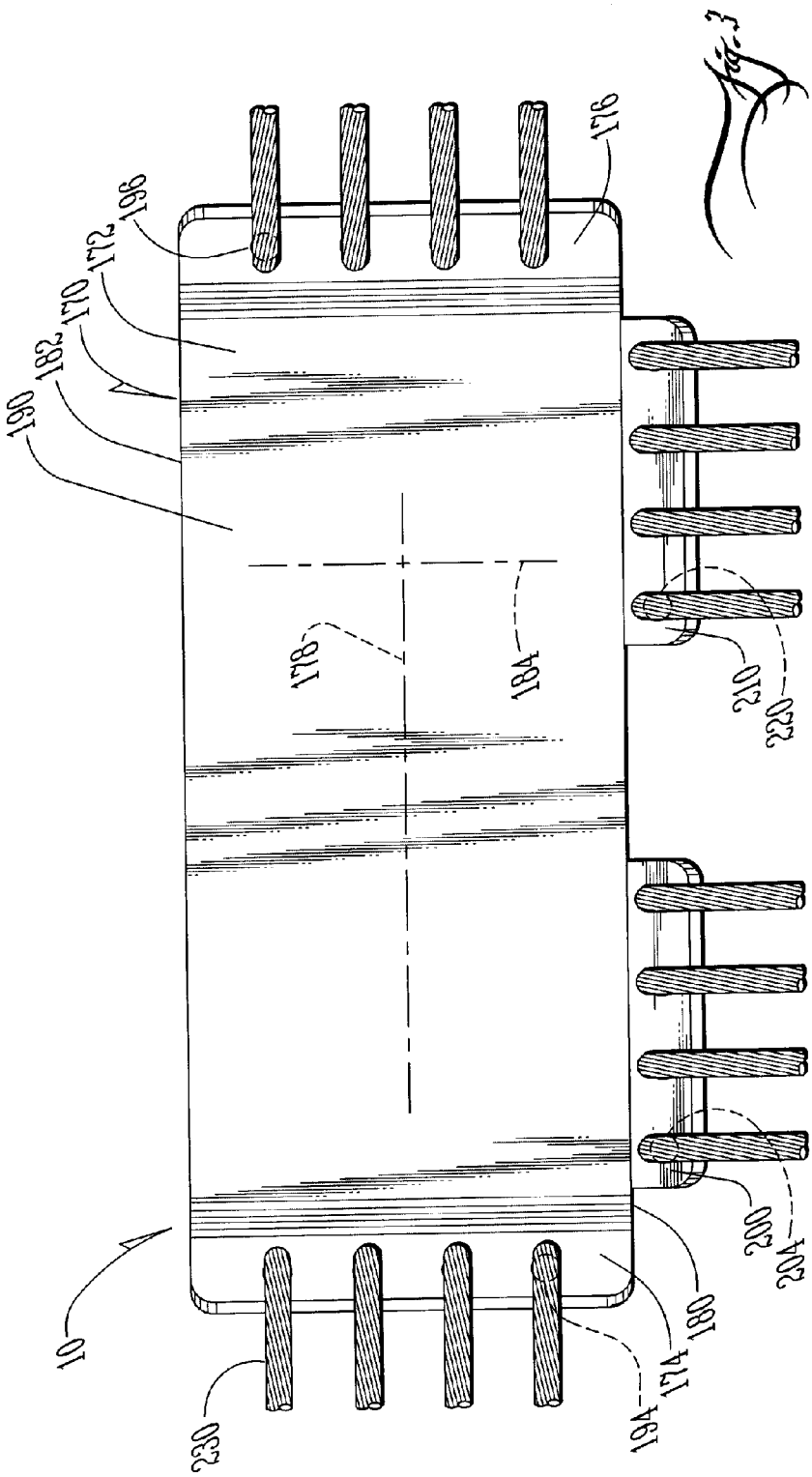
FIG. 3 is a plan view of a standing board included in the kit embodying the present invention.

Kit 10 further includes a standing board 170 best shown in FIGS. 1 and 3. The standing board includes a main body 172 having a first end 174 and a second end 176 with the first and second ends of the standing board being spaced apart from each other along a longitudinal axis 178 of the main body of the standing board. Standing board 170 further includes a first side 180 and a second side 182, with the first and second sides of the standing board being spaced apart from each other along a transverse axis 184 of the main body of the standing board. Standing board further includes a first surface 190 and a second surface 192. A fourth plurality of holes, such as holes 194, are defined through the main body of the standing board adjacent to the first end of the standing board, and a fifth plurality of holes, such as hole 196, are defined through the standing board adjacent to second end 176 of the standing board. A first bracket 200 is attached to the standing board adjacent to the first side of the standing board, with first bracket 200 having a fifth plurality of holes, such as hole 204, defined therethrough. A second bracket 210 is attached to the first surface of the standing board at a location that is spaced apart from first bracket 200 of the standing board along the longitudinal axis of the standing board. A seventh plurality of holes, such as hole 220, is defined through second bracket 210 of the standing board.

A fourth plurality of bungee cords, such as bungee cord 230, are attached to the main body of the standing board via one of the fourth plurality of holes, each bungee cord of the fourth plurality of bungee cords having a unique strength and color, with the color of a bungee cord corresponding to the strength of the bungee cord associated therewith, with a stronger bungee cord having more tension than a weaker bungee cord so that an exercise can be performed with the back board using a combination of bungee cords which corresponds to a desired resistance, A fifth plurality of bungee cords, such as bungee cord 240, are attached to the main body of the standing board via one of the fifth plurality of holes, each bungee cord of the fifth plurality of bungee cords having a unique strength and color, with the color of a bungee cord corresponding to the strength of the bungee cord associated therewith, with a stronger bungee cord having more tension than a weaker bungee cord so that an exercise can be performed with the back board using a combination of bungee cords which corresponds to a desired resistance, A sixth plurality of bungee cords, such as bungee cord 250, are attached to the main body of the standing board via one of the sixth plurality of holes. Each bungee cord of the sixth plurality of bungee cords has a unique strength and color, with the color of a bungee cord corresponding to the strength of the bungee cord associated therewith, with a stronger bungee cord having more tension than a weaker bungee cord so that an exercise can be performed with the back board using a combination of bungee cords which corresponds to a desired resistance.

A seventh plurality of bungee cords, such as bungee cord 260, are attached to the main body of the standing board via one of the seventh plurality of holes. Each bungee cord of the seventh plurality of bungee cords has a unique strength and color, with the color of a bungee cord corresponding to the strength of the bungee cord associated therewith, with a stronger bungee cord having more tension than a weaker bungee cord so that an exercise can be performed with the back board using a combination of bungee cords which corresponds to a desired resistance.

Figure 5:
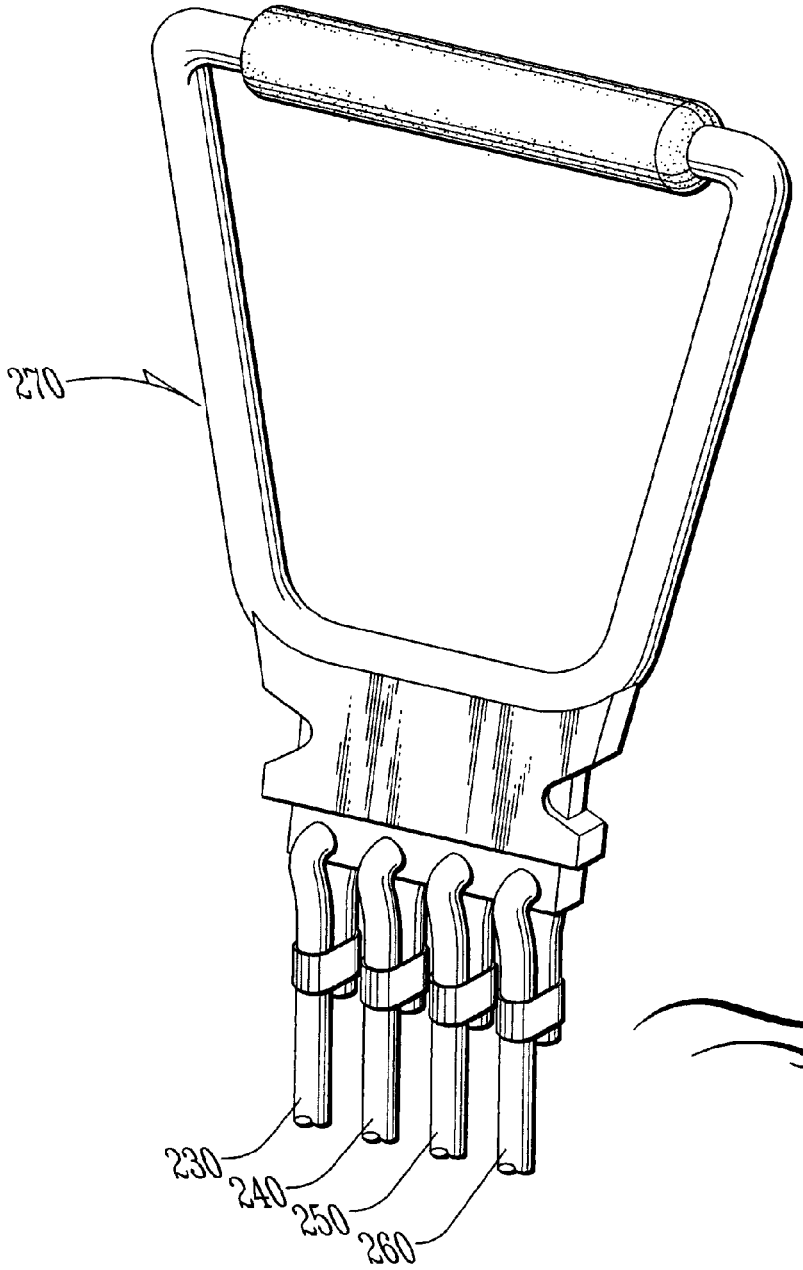
FIG. 5 shows a handle included in the kit embodying the present invention.
Figure 7:
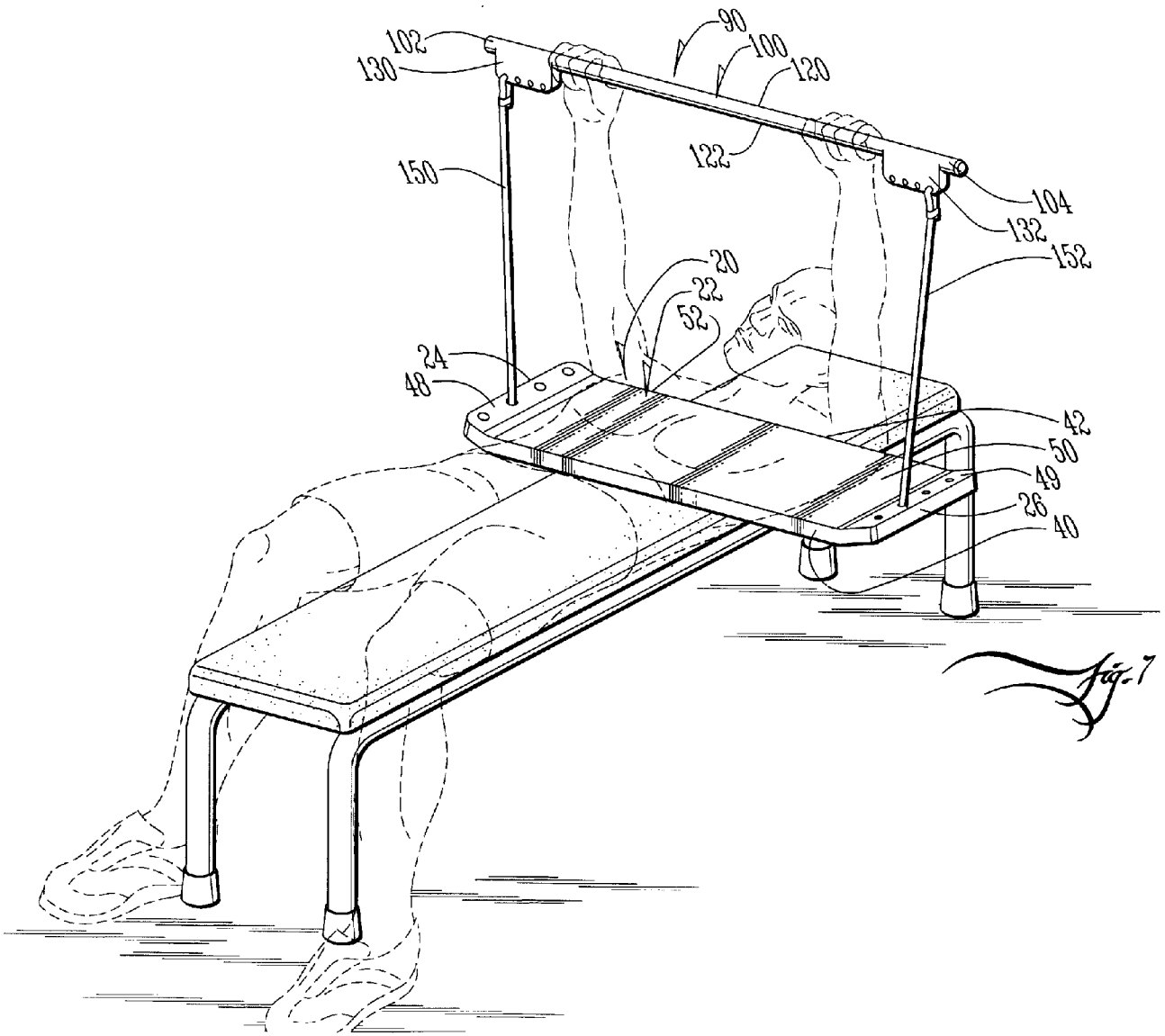
FIG. 7 illustrates a bench press using the standing board and the bench press bar.

Kit 10 further includes two handle units, such as handle unit 270 shown in FIG. 5. Each handle unit is attached to selected bungee cords during use. The bungee cords attach the handles to either the back board or to the bench press bar. Bungee cords can also be used to attach the bench press bar to the back board as shown in FIG. 7.

Figure 8:
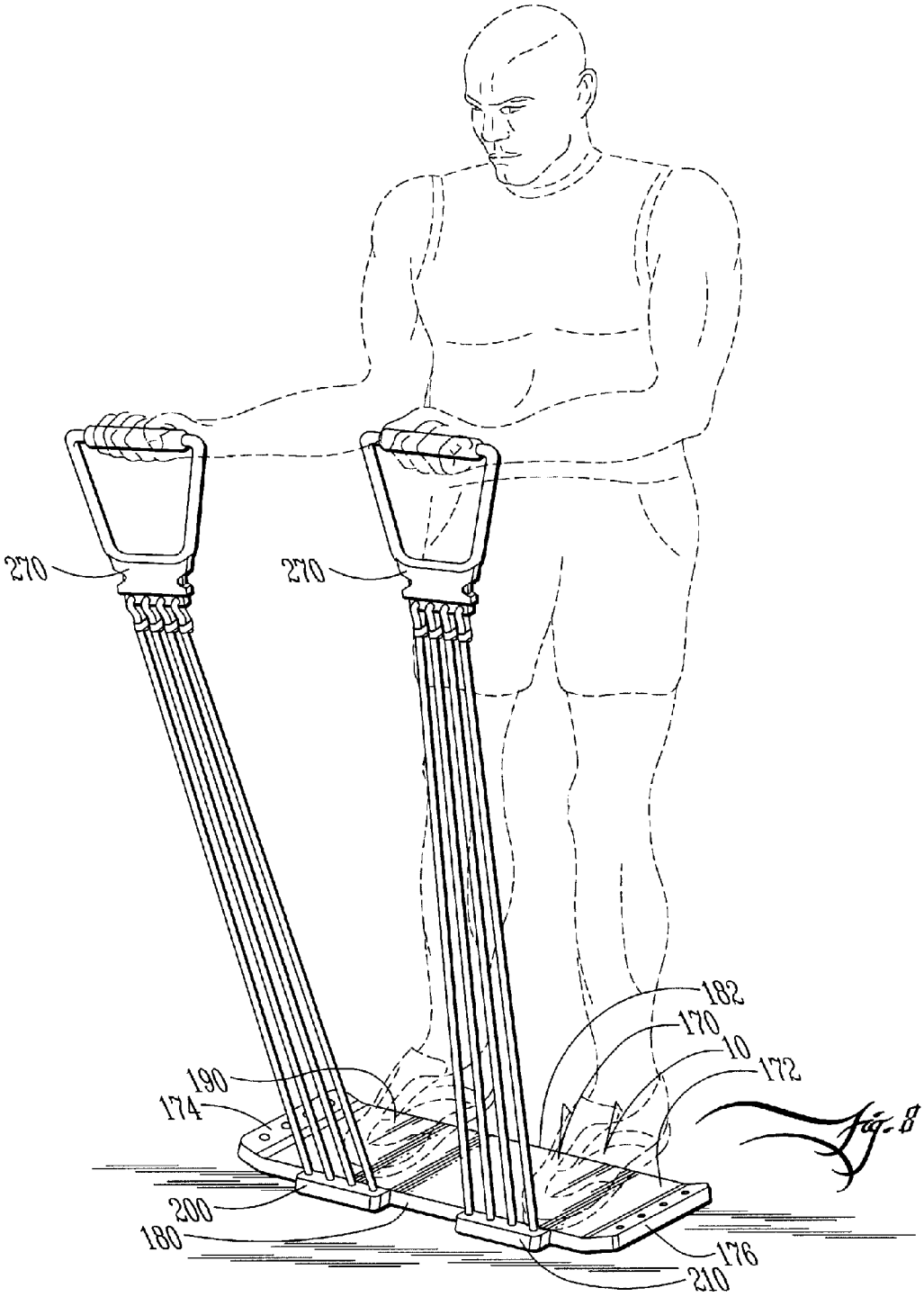
FIG. 8 illustrates a standing front curl using the standing board.

Various exercises are indicated in the figures, with FIG. 6 illustrating an exercise where the back board is used for curls performed during a butterfly exercise using the back board; FIG. 7 illustrating a bench press using the back board and the bench press bar connected by bungee cords; and FIG. 8 illustrating an exercise of standing front curls using the standing board. Other exercises will occur to those skilled in the art based on the teaching of this disclosure.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A gym kit comprising:

A) a back board having (1) a main body with a first end, a second end with the first and second ends being spaced apart from each other along a longitudinal axis of the main body, a first side, a second side with the first and second sides being spaced apart from each other along a transverse axis of the main body, (2) a first surface, (3) a second surface, (4) a first plurality of holes defined through the main body adjacent to each of the first and second ends, (5) a first shoulder support attached to the first surface, (6) a second shoulder support attached to the first surface at a location that is spaced apart from the first shoulder support along the longitudinal axis of the back board, (7) a first plurality of bungee cords, each attached to the main body via one of the first plurality of holes, each bungee cord of the first plurality of bungee cords having a unique strength and color, with the color of each bungee cord corresponding to the strength of the bungee cord associated therewith, with a stronger bungee cord having more tension than a weaker bungee cord so that an exercise can be performed with the back board using a combination of bungee cords which corresponds to a desired resistance, (8) the back board being curved adjacent to the ends thereof and planar between the curved ends, and (9) the first and second shoulder supports being located adjacent to the curves adjacent to the ends of the back board and extending from the first side of the back board and over the first surface of the back board, the first and second shoulder supports being arcuate and adapted to conform to an arcuate shape of the shoulder of the user when the back board is in use;

B) a bench press bar having (1) a main body with a first end, a second end with the first and second ends of the bench press bar being spaced apart from each other along a longitudinal axis of the bench press bar, a first side, a second side with the first and second sides of the bench press bar being spaced apart from each other along a transverse axis of the bench press bar, (2) a first surface, (3) a second surface, (4) a first bracket mounted on the back board adjacent to the first end of the bench press bar, (5) a second bracket mounted on the second surface of the bench press bar adjacent to the second end of the bench press bar, the second bracket being spaced apart from the first bracket along the longitudinal axis of the bench press bar, (6) a second plurality of holes defined through the first bracket, (7) a third plurality of holes defined through the second bracket, (8) a second plurality of bungee cords attached to first bracket via the second plurality of holes in the first bracket, a third plurality of bungee cords attached to the bench press bar via the third plurality of holes in the second bracket, each bungee cord of the second and third plurality of bungee cords having a unique strength and color, with the color of a bungee cord corresponding to the strength of the bungee cord associated therewith, with a stronger bungee cord having more tension than a weaker bungee cord so that an exercise can be performed with the bench press bar using a combination of bungee cords which corresponds to a desired resistance;

C) a standing board having (1) a main body with a first end, a second end with the first and second ends of the standing board being spaced apart from each other along a longitudinal axis of the main body of the standing board, a first side, a second side with the first and second sides of the standing board being spaced apart from each other along a transverse axis of the main body of the standing board, (2) a first surface, (3) a second surface, (4) a fourth plurality of holes defined through the main body of the standing board adjacent to the first end of the standing board, (5) a fifth plurality of holes defined through the main body of the standing board adjacent to the second end of the standing board, (6) a first bracket attached to the standing board adjacent to the first end of the standing board, (7) a sixth plurality of holes defined through the first bracket of the standing board, (8) a second bracket attached to the standing board at a location that is spaced apart from the first bracket of the standing board along the longitudinal axis of the standing board, (9) a seventh plurality of holes defined through the second bracket of the standing board,

(10) a fourth plurality of bungee cords, each attached to the main body of the standing board via one of the fourth plurality of holes, each bungee cord of the fourth plurality of bungee cords having a unique strength and color, with the color of a bungee cord corresponding to the strength of the bungee cord associated therewith, with a stronger bungee cord having more tension than a weaker bungee cord so that an exercise can be performed with the back board using a combination of bungee cords which corresponds to a desired resistance,

(11) a fifth plurality of bungee cords, each attached to the main body of the standing board via one of the fifth plurality of holes, each bungee cord of the fifth plurality of bungee cords having a unique strength and color, with the color of a bungee cord corresponding to the strength of the bungee cord associated therewith, with a stronger bungee cord having more tension than a weaker bungee cord so that an exercise can be performed with the back board using a combination of bungee cords which corresponds to a desired resistance,

(12) a sixth plurality of bungee cords, each attached to the main body of the standing board via one of the sixth plurality of holes, each bungee cord of the sixth plurality of bungee cords having a unique strength and color, with the color of a bungee cord corresponding to the strength of the bungee cord associated therewith, with a stronger bungee cord having more tension than a weaker bungee cord so that an exercise can be performed with the back board using a combination of bungee cords which corresponds to a desired resistance;

(13) a seventh plurality of bungee cords, each attached to the main body of the standing board via one of the seventh plurality of holes, each bungee cord of the seventh plurality of bungee cords having a unique strength and color, with the color of a bungee cord corresponding to the strength of the bungee cord associated therewith, with a stronger bungee cord having more tension than a weaker bungee cord so that an exercise can be performed with the back board using a combination of bungee cords which corresponds to a desired resistance; and D) two handles each of which is attached to an associated bungee cord during use.

* * * * *